US009658550B2

(12) United States Patent
Murayama et al.

(10) Patent No.: US 9,658,550 B2
(45) Date of Patent: May 23, 2017

(54) TONER FOR USE IN ELECTROPHOTOGRAPHIC SYSTEMS

(71) Applicant: CANON KABUSHIKI KAISHA, Tokyo (JP)

(72) Inventors: Ryuji Murayama, Nagareyama (JP); Hayato Ida, Toride (JP); Takaho Shibata, Tokyo (JP); Junichi Tamura, Toride (JP); Daisuke Yamashita, Kashiwa (JP); Akemi Watanabe, Hiratsuka (JP); Kouichirou Ochi, Chiba (JP); Yuya Chimoto, Tokyo (JP); Tomoyo Miyakai, Kashiwa (JP); Takashi Hirasa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/165,945

(22) Filed: May 26, 2016

(65) Prior Publication Data

US 2016/0349645 A1 Dec. 1, 2016

(30) Foreign Application Priority Data

May 27, 2015 (JP) ..... 2015-107872
Apr. 26, 2016 (JP) ..... 2016-088543

(51) Int. Cl.
*G03G 9/087* (2006.01)

(52) U.S. Cl.
CPC ..... *G03G 9/08755* (2013.01); *G03G 9/08724* (2013.01)

(58) Field of Classification Search
CPC ..... G03G 9/08755; G03G 9/08704; G03G 9/08724; G03G 9/08788
See application file for complete search history.

(56) References Cited

U.S. PATENT DOCUMENTS

2004/0209181 A1 10/2004 Higuchi

FOREIGN PATENT DOCUMENTS

| | | | | |
|---|---|---|---|---|
| DE | 2542374 | * | 4/1976 | ..... G03G 9/08 |
| JP | 56-13943 | B | 4/1981 | |
| JP | 58-95750 | A | 6/1983 | |
| JP | 59-18954 | A | 1/1984 | |
| JP | 62-39428 | B2 | 8/1987 | |
| JP | 3-150576 | A | 6/1991 | |
| JP | 4-21860 | A | 1/1992 | |
| JP | 4-120554 | A | 4/1992 | |
| JP | H06-308764 | A | 11/1994 | |
| JP | 8-184986 | A | 7/1996 | |
| JP | 11-202555 | A | 7/1999 | |
| JP | 2011-107261 | A | 6/2011 | |
| JP | 2011-237790 | A | 11/2011 | |

* cited by examiner

*Primary Examiner* — Peter Vajda
(74) *Attorney, Agent, or Firm* — Canon U.S.A., Inc., IP Division

(57) ABSTRACT

Toner containing toner particles having a resin component, in which the resin component has an olefin-based copolymer and a crystalline polyester resin, the olefin-based copolymer has a unit Y1 represented by Formula (1) and at least one kind of unit Y2 selected from the group consisting of a unit represented by Formula (2) and a unit represented by Formula (3), a content of the olefin-based copolymer contained in the resin component is 50% by mass or more based on a total mass of the resin component, a content of the unit Y2 is 3% by mass or more and 35% by mass or less based on a total mass of the olefin-based copolymer, and a melt flow rate of the olefin-based copolymer is 30 g/10 min or less.

8 Claims, No Drawings

TONER FOR USE IN ELECTROPHOTOGRAPHIC SYSTEMS

BACKGROUND

Field of the Disclosure

The present disclosure relates to a dry type toner for use in an electrophotographic system.

Description of the Related Art

In recent years, in connection with an increase in a demand for energy saving in image formation, measures for further lowering the fixing temperature of toner have been increasingly taken. As one of the measures, it has been proposed to further lower the fixing temperature by the use of a polyester resin having a low softening temperature. However, since the softening temperature is low, melt-adhesion of toner particles occur in a stationary state during storage, transportation, and the like to cause blocking in some cases.

Japanese Patent Publication Nos. 56-13943 and 62-39428 and Japanese Patent Laid-Open No. 4-120554 have proposed techniques of using a crystalline polyester resin having a sharp melt property in which the viscosity sharply decreases when the temperature exceeds the melting point as a means for achieving both blocking characteristics and low-temperature fixability.

Moreover, Japanese Patent Laid-Open Nos. 2011-107261, 11-202555, 8-184986, 4-21860, 3-150576, 59-18954, and 58-95750 also have proposed toner containing an ester containing ethylene copolymer, such as an ethylene-vinyl acetate copolymer, an ethylene-ethyl acrylate copolymer, or an ethylene-methyl methacrylate copolymer, in order to improve fixability.

When a former crystalline polyester resin has been used as a main binding resin of an electrophotographic toner, the crystalline polyester resin has been excellent from the viewpoint of achieving both fixability and blocking characteristics due to the sharp melt property of the resin. However, the crystalline polyester resin has low electrical resistance, and thus has had a problem with chargeability.

Then, it has also been proposed to use a crystalline polyester resin and an amorphous polyester resin in combination. However, it has been necessary to increase the glass transition temperature of the amorphous polyester resin forming a matrix to be equal to or higher than the storage environmental temperature in order to satisfy blocking property. In that case, it has been difficult to satisfy low-temperature fixability under high-speed printing conditions.

Moreover, Japanese Patent Laid-Open Nos. 2011-107261, 11-202555, 8-184986, and 4-21860 have also proposed to partially blend an ethylene-vinyl acetate copolymer or an ethylene-ethyl acrylate copolymer in toner but it has been difficult to satisfy the low-temperature fixability under high-speed printing conditions only by partially blending the copolymers.

The present inventors have examined, and then have found that it is the most effective to lower the glass transition temperature of a binding resin which is a main component of toner in order to improve the low-temperature fixability at a high speed.

However, it has been disadvantageous to lower the glass transition temperature of a binding resin in that the storage property and the electrical resistance are reduced, so that the chargeability as toner deteriorates. Then, the present inventors have focused on an olefin-based copolymer having high electrical resistance and a glass transition temperature equal to or lower than room temperature. Specifically, the present inventors have attempted to achieve both chargeability and fixability by using, as the main resin, ethylene-acetate ester copolymers such as an ethylene-vinyl acetate copolymer, ethylene-acrylic acid ester copolymers such as an ethylene-methyl acrylate, ethylene-methacrylate ester copolymers such as an ethylene-methyl methacrylate, or the like. However, for the use of a low molecular weight olefin-based copolymer as the main resin of toner as in Japanese Patent Laid-Open No. 59-18954, the strength as resin is low, which has posed a problem with storage stability. On the other hand, for the use of a high molecular weight olefin-based copolymer as the main resin as in Japanese Patent Laid-Open No. 58-95750, the gloss of an obtained image decreases because the melt viscosity in fixing is excessively high. Furthermore, when a high molecular weight olefin-based copolymer is used as the main resin, the dispersibility of a pigment is poor, which has posed a problem that the image density of a fixed substance decreases. Then, the present disclosure provides toner excellent in image quality and excellent in low-temperature fixability in high-speed printing, blocking, and chargeability.

SUMMARY OF THE DISCLOSURE

Then, as a result of an extensive examination by the present inventors, the present inventors have clarified that, by the use of a high molecular weight olefin-based copolymer, specifically, ethylene-acetate ester copolymers such as an ethylene-vinyl acetate copolymer, ethylene-acrylic acid ester copolymers such as ethylene-methyl acrylate, ethylene-methacrylate ester copolymers such as ethylene-methyl methacrylate, and a mixture thereof as the main resin and the use of a crystalline polyester in combination, the image quality is improved, the blocking property during storage is improved, and both the low-temperature fixability at a high speed and chargeability can be achieved.

More specifically, the toner of the present disclosure relates to toner containing toner particles containing a resin component, in which the resin component has an olefin-based copolymer and a crystalline polyester resin, the olefin-based copolymer has a unit Y1 represented by the following formula (1) and at least one kind of unit Y2 selected from the group consisting of a unit represented by the following formula (2) and a unit represented by the following formula (3), a content of the olefin-based copolymer contained in the resin component is 50% by mass or more based on a total mass of the resin component, a content of the unit Y2 is 3% by mass or more and 35% by mass or less based on a total mass of the olefin-based copolymer, and the melt flow rate of the olefin-based copolymer is 30 g/10 min or less, Formula (1)

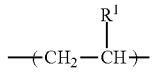

Formula (2)

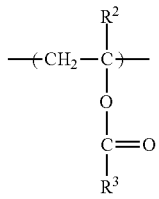

-continued

Formula (3)

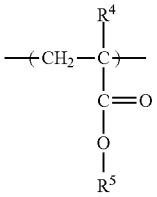

(in Formulae (1) to (3), $R^1$ is H or $CH_3$, $R^2$ is H or $CH_3$, $R^3$ is $CH_3$ or $C_2H_5$, $R^4$ is H or $CH_3$, and $R^5$ is $CH_3$ or $C_2H_5$).

Further features of the present disclosure will become apparent from the following description of exemplary embodiments.

DESCRIPTION OF THE EMBODIMENTS

In the present disclosure, the resin component refers to a polymer component which mainly contributes to fixing performance. Hereinafter, an olefin-based copolymer and a crystalline polyester can be mentioned as desirable components.

Hereinafter, the olefin-based copolymer having a unit Y1 represented by Formula (1) and at least one kind of unit Y2 selected from the group consisting of a unit represented by Formula (2) and a unit represented by Formula (3) of the present disclosure is described.

As the olefin-based copolymer of the present disclosure, an ethylene-vinyl acetate copolymer having a unit represented by Formula (1) above, in which $R^1$ in Formula (1) above is H and a unit represented by Formula (3) above, in which $R^4$ in Formula (3) above is H and $R^5$ in Formula (3) above is $CH_3$ is mentioned, for example. An ethylene-ethyl acrylate copolymer having a unit represented by Formula (1) above, in which $R^1$ in Formula (1) above is H and a unit represented by Formula (3) above, in which $R^4$ in Formula (3) above is H and $R^5$ in Formula (3) above is $C_2H_5$ is mentioned. Moreover, an ethylene-methyl methacrylate copolymer having a unit represented by Formula (1) above, in which $R^1$ in Formula (1) above is H and a unit represented by Formula (3) above, in which $R^4$ in Formula (3) above is $CH_3$ and $R^5$ in Formula (3) above is $CH_3$ is mentioned. Moreover, an ethylene-methyl acrylate copolymer having a unit represented by Formula (1) above, in which $R^1$ in Formula (1) above is H and a unit represented by Formula (3) above, in which $R^4$ in Formula (3) above is H and $R^5$ in Formula (3) above is $CH_3$ is mentioned.

As the olefin-based copolymer, the ethylene-vinyl acetate copolymer is suitable from the viewpoint that both low-temperature fixability and charge holding properties can be easily achieved because the melting point is low even when the ester group density is low. Moreover, acrylic acid ester copolymers, such as ethylene-ethyl acrylate or ethylene-methyl acrylate copolymers or an ethylene-methyl methacrylate copolymer, are suitable from the viewpoint that the storage property under high temperatures and high humidities is high due to high chemical stability.

The resin component may contain one kind or two or more kinds of the olefin-based copolymers.

The total mass of the olefin-based copolymer is defined as w and the mass of the unit represented by Formula (1), the mass of the units represented by Formula (2), and the mass of the units represented by Formula (3) are defined as l, m, and n, respectively. The (l+m+n)/W value is preferably 0.8 or more from the viewpoint of low-temperature fixability or charge retentivity and more preferably 0.95 or more.

Examples of units which may be contained in the olefin-based copolymer other than the unit represented by Formula (1), the unit represented by Formula (2) and the unit represented by Formula (3) include a unit represented by Formula (4) and a unit represented by Formula (5), for example. These units can be introduced by adding an equivalent monomer in a copolymerization reaction of producing the olefin-based ester group containing copolymer or denaturing the olefin-based ester group containing copolymer by a polymer reaction.

Formula (4)

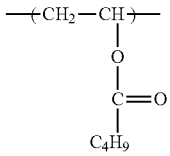

Formula (5)

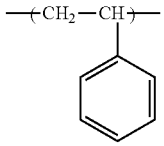

The olefin-based copolymer needs to be contained in a proportion of 50% by mass or more based on the total mass of the resin components and more preferably contained in a proportion of 70% by mass or more from the viewpoint of low-temperature fixing at a high speed. Due to the fact that the olefin-based copolymer is contained in a proportion of 50% by mass or more in the resin component, the low-temperature fixability at a high speed is improved because the glass transition temperature of the olefin-based copolymer is 0° C. or less.

The content of the unit Y2 needs to be 3% by mass or more and 35% by mass or less and more preferably 5% by mass or more and 20% by mass or less based on the total mass of the olefin-based copolymer. Due to the fact that the content of the unit Y2 of the olefin-based copolymer is 35% by mass or less, the charge holding properties as toner are improved. When the content is 20% by mass or less, the charge holding properties as toner are further improved. On the other hand, due to the fact that the content of the unit Y2 of the olefin-based copolymer is 3% by mass or more, the adhesiveness to paper is improved and the low-temperature fixability becomes good. When the content is 5% by mass or more, the adhesiveness to paper and the low-temperature fixability are further improved.

The mass l, m, and n of each of the units, the content of the unit Y2 represented by Formula (2) and the content of the unit Y2 represented by Formula (3) can be measured using general analysis methods. For example, methods, such as a nuclear magnetic resonance method (NMR) and a pyrolysis gas chromatography method, can be applied to the measurement.

The measurement by $^1H$ NMR is performed by the following method. By comparing the integration ratios of hydrogen of alkenyl in the unit Y1 represented by Formula (1), hydrogen of an acetyl group in the unit represented by Formula (2), and hydrogen of a methyl group or an ethylene group bonded to oxygen in the unit represented by Formula (3), each unit ratio can be calculated.

For example, the calculation of the unit ratio of the ethylene-vinyl acetate copolymer (Unit ratio derived from vinyl acetate: 15% by mass) was performed by putting a solution, in which about 5 mg of a specimen was dissolved, in 0.5 ml of heavy acetone containing internal standard tetramethylsilane (0.00 ppm) into a specimen tube, and then measuring the $^1$H NMR under the conditions of the repetition time of 2.7 seconds and the cumulative number of 16 times. Then, the peak at 1.14 to 1.36 ppm was equivalent to $\underline{CH_2}$—$\underline{CH_2}$ of the ethylene unit and the peak around 2.04 ppm was equivalent to $\underline{CH_3}$ of the vinyl acetate unit, and therefore the calculation was performed by calculating the integral value ratio of the peaks.

The melt flow rate of the olefin-based copolymer needs to be 30 g/10 min or less. When the melt flow rate is higher than 30 g/10 min, the strength as toner is low, so that blocking occurs during storage. Moreover, from the viewpoint of the resistance against impact and pressure during the use of the toner, 20 g/10 min or less is more preferable. Moreover, it is suitable for the olefin-based copolymer to have a melt flow rate of 5 g/10 min or more from the viewpoint of the gloss of an image.

The melt flow rate was measured under the conditions of 190° C. and a 2160 g load based on JIS K 7210. When two or more of the olefin-based copolymers are contained in the resin component, the measurement was performed under the above-described conditions after melting and mixing.

The melt flow rate can be controlled by varying the molecular weight of the olefin-based copolymer. The melt flow rate can be lowered by increasing the molecular weight. Specifically, as the molecular weight of the olefin-based copolymer, the weight average molecular weight is preferably 50000 or more and more preferably 100000 or more. The molecular weight of the olefin-based copolymer is preferably 500000 or less from the viewpoint of the gloss of an image.

The olefin-based copolymer preferably has fracture elongation of 300% or more and more preferably has fracture elongation of 500% or more. Due to the fact that the fracture elongation is 300% or more, the bending resistance of a fixed substance becomes good.

The fracture elongation was measured under the conditions based on JIS K 7162. When two or more of the olefin-based copolymers are contained in the resin component, the measurement was performed under the above-described conditions after melting and mixing.

Toner particles according to the present disclosure contain a crystalline polyester resin as the resin component. Due to the fact that a crystalline polyester resin is contained, the viscosity in heating and melting of toner containing the olefin-based copolymer having a high melt flow rate decreases and an image with high gloss can be obtained. Furthermore, the crystalline polyester resin acts as a pigment dispersant to increase the dispersibility of a pigment even in the olefin-based copolymer with a high molecular weight, so that a fixed substance with a high image density can be obtained. Furthermore, the crystalline polyester resin acts as a nucleating agent of the olefin-based copolymer, so that the blocking property during storage and the chargeability become good.

The crystalline polyester resin is preferably contained in a proportion of 10 parts by mass or more and 30 parts by mass or less in 100 parts by mass of the resin component. When the content of the crystalline polyester resin is within the range mentioned above, the viscosity reduction effect and the effect as a nucleating agent can be sufficiently obtained without reducing the chargeability.

The crystalline polyester resin for use in the present disclosure is not particularly limited and a structure is mentioned which is obtained by condensation polymerization of at least one kind of dicarboxylic acid component and at least one kind of diol component.

As the diol, the following substances are specifically mentioned and aliphatic diols having carbon atoms of 4 or more and 20 or less are suitable from the viewpoint of the ester group density and the melting point. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, 2-methyl-1,3-propanediol, cyclohexanediol, and cyclohexane dimethanol. These substances may be used alone or in combination of two or more kinds thereof.

As the dicarboxylic acids, the following substances are specifically mentioned and aliphatic dicarboxylic acids having 4 to 20 carbon atoms are suitable from the viewpoint of the melting point. Examples of the aliphatic carboxylic acids include oxalic acid, malonic acid, maleic acid, fumaric acid, citraconic acid, itaconic acid, glutaconic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, and 1,18-octadecane dicarboxylic acid. These substances may be used alone or in combination of two or more kinds thereof.

The acid value of the crystalline polyester resin for use in the present disclosure is preferably 5 mgKOH/g or more and 30 mgKOH/g or less. Due to the fact that the acid value is 5 mgKOH/g or more, the dispersibility of a pigment is improved. By setting the acid value to 30 mgKOH/g or less, the chargeability in a high humidity environment is improved.

The acid value refers to the number in terms of mg of potassium hydroxide required for neutralizing an acid component, such as free fatty acid and resin acid, contained in 1 g of a specimen. As a measuring method, the acid value is measured as follows according to JIS-K0070.

(1) Reagent

Solvent: A tetrahydrofuran-ethyl alcohol mixed liquid (2:1) is neutralized with 0.1 mol/L of a potassium hydroxide ethyl alcohol solution using phenolphthalein as an indicator immediately before use.

Phenolphthalein solution: 1 g of phenolphthalein is melt in 100 mL of ethyl alcohol (95% by volume).

0.1 mol/L of potassium hydroxide ethyl alcohol solution: 7.0 g of potassium hydroxide is melted in the smallest possible amount of water, ethyl alcohol (95% by volume) is added to give 1 L, and then the mixture is allowed to stand for 2 to 3 days, followed by filtration. The standardization is performed according to JIS K 8006 (Fundamentals relating to titration among quantitative tests of reagents).

(2) Operation 1 to 20 g of a core resin is accurately weighed as a specimen, 100 mL of the solvent and several drops of the phenolphthalein solution as an indicator are added to the core resin, and then the mixture is sufficiently shaken until the specimen is completely melted. In the case of a solid specimen, the solid specimen is warmed to be melted on a water bath. After cooling, the resultant substance is titrated with the 0.1 mol/L of potassium hydroxide ethyl alcohol solution. Then, the point where the slightly red color of the indicator continues for 30 seconds is defined as the terminal point of the neutralization.

(3) Equation

The acid value is calculated by the following equation.

$$A=B\times f\times 5.611/S$$

A: Acid value (mgKOH/g)

B: Use amount (mL) of 0.1 mol/L potassium hydroxide ethyl alcohol solution f: Factor of 0.1 mol/L potassium hydroxide ethyl alcohol solution S: Specimen (g)

The weight average molecular weight (Mw) measured using gel permeation chromatography of the crystalline polyester resin for use in the present disclosure is preferably 5000 or more and 50000 or less and more preferably 5000 or more and 20000 or less.

By setting the weight average molecular weight (Mw) of the crystalline polyester resin to 50000 or less, the olefin-based copolymer can be plasticized to be easily formed into toner by a method described later and the low-temperature fixability is also improved. By setting the weight average molecular weight (Mw) to 5000 or more, the strength as toner can be increased.

The weight average molecular weight (Mw) of the crystalline polyester resin can be easily controlled by various known production conditions of the crystalline resin.

The weight average molecular weight (Mw) of the crystalline polyester resin is measured as follows using gel permeation chromatography (GPC).

Special grade 2,6-di-t-butyl-4-methylphenol (BHT) is added to o-dichlorobenzene for gel chromatography in such a manner so that the density is 0.10% by mass or more, and then dissolved at room temperature. A crystalline resin and the o-dichlorobenzene to which the BHT is added are put into a sample bottle, and then the sample bottle is heated on a hot plate set to 150° C. to dissolve the crystalline polyester resin.

When the crystalline polyester resin is melted, the crystalline polyester resin is put into a filter unit heated beforehand, and then the filter unit is placed on a main body. One which is passed through the filter unit is used as a GPC sample.

The sample solution is adjusted in such a manner that the density is 0.15% by mass or more.

The measurement is performed under the following conditions using the sample solution.

Apparatus: HLC-8121 GPC/HT (manufactured by TOSOH CORP.)

Detector: RI for high temperature

Column: TSKgel GMHHR-H HT Double column (manufactured by TOSOH CORP.)

Temperature: 135.0° C.

Solvent: o-dichlorobenzene for gel chromatography (BHT addition amount: 0.10% by mass or more)

Flow rate: 1.0 mL/min

Injection amount: 0.4 mL

For the calculation of the molecular weight of the crystalline polyester resin, the molecular weight calibration curves created using a standard polystyrene resin (Trade name "TSK standard Polystyrene F-850, F-450, F-288, F-128, F-80, F-40, F-20, F-10, F-4, F-2, F-1, A-5000, A-2500, A-1000, and A-500", manufactured by TOSOH CORP.) are used.

In the present disclosure, the melting point of the crystalline polyester is preferably 50° C. or more and 100° C. or less from the viewpoint of low-temperature fixability and storage stability. Due to the fact that the melting point is 100° C. or less, the low-temperature fixability is further improved. Due to the fact that the melting point is 90° C. or less, the low-temperature fixability is further improved. On the other hand, when the melting point is lower than 50° C., the storage stability tends to decrease.

The melting point of the crystalline resin can be measured using a differential scanning calorimeter (DSC) "Q2000" (manufactured by TA Instruments).

Specifically, 0.01 to 0.02 g of a specimen is accurately weighed in an aluminum pan, and then the temperature is increased from 0° C. to 200° C. at a temperature rise rate of 10° C./min to obtain a DSC curve.

From the obtained DSC curve, the peak temperature of the endothermic peak is defined as the melting point.

The crystallinity of the crystalline polyester resin for use in the present disclosure is preferably 10% or more and more preferably 20 to 60%. Due to the fact that the crystallinity is 10% or more, the crystalline polyester resin serves as a nucleating agent of the olefin-based copolymer to increase the crystallinity of the entire toner, so that blocking during storage can be prevented.

The crystallinity using a wide angle X-ray diffraction method can be measured under the following conditions.

X-ray diffraction apparatus: manufactured by Bruker AXS, D8 ADVANCE

X radiation source: Cu-Kα rays (monochromatized by a graphite monochromator)

Output: 40 kV, 40 mA

Slit system: Slit DS, SS=1°, RS=0.2 mm

Measurement range: 2θ=5° to 60°

Step interval: 0.02°

Scan speed: 1°/min

The X ray diffraction profile of a specimen is separated into the crystal peak and amorphous scattering from the measurement results. Then, the crystallinity can be calculated by the following expression from the areas thereof.

$$\text{Crystallinity (\%)}=Ic/(Ic+Ia)\times 100$$

Ic: Sum of crystal peak areas

Ia: Sum of amorphous scattering areas

In the toner of the present disclosure, other polymers may be used in combination as the resin component besides the olefin-based copolymer. Specifically, polymers mentioned below and the like can be used. Mentioned are styrene and homopolymers of substitution products thereof, such as polystyrene, poly-p-chlorostyrene, and polyvinyl toluene; styrene copolymers, such as a styrene-p-chlorostyrene copolymer, a styrene-vinyltoluene copolymer, a styrene-vinyl naphthalene copolymer, a styrene-acrylic acid ester copolymer, and a styrene-methacrylate ester copolymer; polyvinyl chloride, phenol resin, natural modified phenol resin, natural resin modified maleic acid resin, acrylic resin, methacrylic resin, polyvinyl acetate, silicone resin, polyester resin, polyurethane, polyamide resin, furan resin, epoxy resin, and xylene resin.

It is suitable for the toner particles according to the present disclosure to contain aliphatic hydrocarbon having a melting point of 50 to 100° C. in a proportion of 1 part by mass or more and 40 parts by mass or less based on 100 parts by mass of the resin component. The case where the aliphatic hydrocarbon is contained in a proportion of 1 part by mass or more and 30 parts by mass or less is more suitable.

When the aliphatic hydrocarbon is heated, the olefin-based copolymer can be plasticized. Therefore, by blending the aliphatic hydrocarbon in the toner particles, the olefin-based copolymer forming a matrix is plasticized during heat fixing of toner, so that the low-temperature fixability can be improved. With respect to the melting point of the aliphatic hydrocarbon, the peak temperature of the endothermic peak of the DSC is used as the melting point, similarly to the case of the measurement of the melting point of the crystalline polyester. The aliphatic hydrocarbon having a melting point of 50 to 100° C. acts also as a nucleating agent of the olefin-based copolymer. Therefore, the micro-mobility of the olefin-based copolymer is suppressed and the chargeability is improved. The aliphatic hydrocarbon is preferably contained in a proportion of 1 part by mass or more and 30 parts by mass or less based on 100 parts by mass of the resin component and more preferably contained in a proportion of 10 parts by mass or more and 30 parts by mass or less from the viewpoint of low-temperature fixability and chargeability.

Specific examples of the aliphatic hydrocarbon include saturated hydrocarbon having 20 to 60 carbon atoms, such as hexacosane, tricosane, and hexatricosane.

It is suitable for the toner particles according to the present disclosure to contain silicone oil as a release agent. The release agent generally used for toner, such as alkyl wax, is easily compatible with the olefin-based copolymer, so that a release effect is hard to obtain. By adding the silicone oil, the pigment dispersion property in toner is improved, which makes it possible to easily obtain a high-density image.

As the silicone oil, dimethyl silicone oil, methyl phenyl silicone oil, methyl hydrogen silicone oil, amino-modified silicone oil, carboxyl-modified silicone oil, alkyl-modified silicone oil, and fluorine-modified silicone oil can be used. The viscosity of the silicone oil is preferably 5 to 1000 cP and more preferably 20 to 1000 cP.

As the addition amount of the silicone oil, the silicone oil is preferably contained in a proportion of 1 part by mass or more and 20 parts by mass or less based on 100 parts by mass of the resin component in the respect of obtaining good separation properties while suppressing a reduction in flowability. The case where the addition amount is 5 parts by mass or more and 20 parts by mass or less is more preferable.

The toner of the present disclosure may contain a colorant. The following substances are mentioned as the colorant.

Examples of black colorants include carbon black; and those which are adjusted to black color using a yellow colorant, a magenta colorant, and a cyan colorant. For the colorant, pigments may be used alone but it is more suitable to use a dye and a pigment in combination to increase the clarity from the viewpoint of the image quality of full color images.

The following substances are mentioned as pigments for magenta toner. Mentioned are C.I. Pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; C.I. Vat Red 1, 2, 10, 13, 15, 23, 29, and 35.

The following substances are mentioned as dyes for magenta toner. Mentioned are C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; oil-soluble dyes, such as C.I. Disperse Violet 1, C.I. Basic Red 1, 2, 9, 12, 13, 14, 15, 17, 18, 22, 23, 24, 27, 29, 32, 34, 35, 36, 37, 38, 39, and 40; and basic dyes, such as C.I. Basic Violet 1, 3, 7, 10, 14, 15, 21, 25, 26, 27, and 28.

The following substances are mentioned as pigments for cyan toner. Mentioned are C.I. Pigment Blue 2, 3, 15:2, 15:3, 15:4, 16, and 17; C.I. Vat Blue 6; C.I. Acid Blue 45, and copper phthalocyanine pigments in which one or more and five or less phthalimide methyl groups are substituted in the phthalocyanine frame.

C.I. Solvent Blue 70 is mentioned as a dye for cyan toner.

The following substances are mentioned as pigments for yellow toner. Mentioned are C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellow 1, 3, and 20.

C.I. Solvent Yellow 162 is mentioned as a dye for yellow toner.

These colorants can be used alone, as a mixture, or in a solid solution state. The colorants are selected from the viewpoint of the hue angle, color saturation, brightness, lightfastness, OHP transparency, and dispersibility in toner.

In the present disclosure, the content of the colorants is preferably 1 part by mass or more and 20 parts by mass or less based on 100 parts by mass of the resin component.

It is suitable for the toner of the present disclosure to have a median diameter on a volume basis of 4.0 to 7.0 μm from the viewpoint of obtaining a high-resolution image.

It is also suitable for the toner of the present disclosure to have an endothermic amount in DSC measurement of preferably 70 J/g or more and 150 J/g or less and more preferably 80 J/g or more and 150 J/g or less. The endothermic amount shows the crystallization states of the olefin-based copolymer and the crystalline polyester. Due to the fact that the endothermic amount is 70 J/g or more, the blocking property during storage is improved due to the physical crosslinking effect by crystallization. When the endothermic amount becomes larger than 150 J/g, the low-temperature fixability decreases. The endothermic amount can be controlled by the addition amount of the crystalline polyester serving as a nucleating agent or the aliphatic hydrocarbon and annealing described later.

The endothermic amount of toner is measured using the above-described DSC.

Specifically, about 5 mg of toner is accurately weighed, and then placed in an aluminum pan. Then, the measurement is performed within the measurement range of 30° C. or more and 200° C. or less at a temperature rise rate of 10° C./min using an empty aluminum pan as a reference. The temperature is increased to 180° C. once, and then held at the temperature for 10 minutes. Subsequently, the temperature is decreased to 30° C., and then the temperature is increased again. In the second temperature increasing process, specific heat changes are obtained within the temperature range of 30° C. or more and 100° C. or less. In the obtained temperature-endothermic amount curve, the endothermic amount is determined from the area of the maximum endothermic peak of the temperature-endothermic amount curve in the temperature range of 30° C. or more and 100° C. or less. A method for producing the toner of the present disclosure is described. The toner of the present disclosure can be produced by arbitrary methods and is suitably an emulsion aggregation toner produced by an emulsion aggregation method described later.

The emulsion aggregation method is a production method including preparing a dispersion liquid of resin fine particles having a sufficiently small particle diameter with respect to the target particle diameter beforehand, and then aggregating the resin fine particles in an aqueous medium to thereby produce toner particles.

In the emulsion aggregation method, the toner is produced through an emulsification process of the resin fine particles, an aggregation process, a fusion process, a cooling process, and a washing process. Hereinafter, a method for producing toner employing the emulsion aggregation method is specifically described but is not limited thereto.

Emulsification Process of Resin Fine Particles

In the emulsion aggregation method, resin fine particles are prepared first. The resin fine particles can be produced by known methods and are suitably produced by the following method.

The olefin-based copolymer and the crystalline polyester are dissolved in an organic solvent to form a uniform dissolved liquid. Thereafter, a basic compound and, as necessary, a surfactant are added. Furthermore, an aqueous medium is added to the dissolved liquid to form fine particles. Finally, it is suitable to remove the solvent to create a resin fine particle dispersion liquid in which the resin fine particles are dispersed. When the resin fine particles are formed by subjecting the olefin-based copolymer and crystalline polyester to a co-emulsification technique, the crystalline polyester serves as a plasticizer, which facilitates the atomization of an organic phase containing the olefin-based copolymer having a low melt flow rate. Furthermore, the crystalline polyester and the olefin-based copolymer are mixed in the fine particles in the atomized organic phase, so that a polar group of the crystalline polyester can improve the dispersion stability of the emulsion liquid. As a result, the particle size distribution control as toner is facilitated.

More specifically, the olefin-based copolymer and the crystalline polyester are thermally melted in an organic solvent, and then a surfactant and a base are added. Subsequently, the aqueous medium is slowly added while giving shearing by a homogenizer or the like to thereby create a co-emulsion liquid containing resin (resin fine particle dispersion liquid). Or, shearing is given by a homogenizer or the like after adding the aqueous medium to thereby create a co-emulsion liquid containing resin. Thereafter, the solvent is removed by heating or decompressing to thereby create a co-emulsion liquid of resin fine particles (resin fine particle dispersion liquid).

The density of the resin component to be dissolved in the organic solvent is preferably 10% by mass or more and 50% by mass or less and more preferably 30% by mass or more and 50% by mass or less based on the organic solvent. As the organic solvent to be used for dissolution, any solvent can be used insofar as the resin can be dissolved and solvents having high solubility in the olefin-based copolymer, such as toluene, xylene, and ethyl acetate, are suitable.

The surfactant used in the emulsification is not particularly limited. For example, mentioned are anionic surfactants, such as sulfuric acid ester salt surfactants, sulfonate surfactants, carboxylate surfactants, phosphate ester surfactants, and soap-based surfactants; cationic surfactants, such as an amine salt type and a quaternary ammonium salt type; and nonionic surfactants, such as polyethylene glycol surfactants, alkylphenolethylene oxide adduct surfactants, and polyhydric alcohol surfactants. It is suitable to use two kinds of sulfonate surfactants and carboxylate surfactants from the viewpoint of particle diameter controllability of an aggregation process described later.

Examples of the base used in the emulsification include inorganic salt groups, such as sodium hydroxide and potassium hydroxide, and organic bases, such as triethyl amine, trimethylamine, dimethylaminoethanol, and diethylaminoethanol. The bases may be used alone or in combination of two or more kinds thereof.

The median diameter on a volume basis of the resin fine particles is preferably 0.05 μm or more and 1.0 μm or less and more preferably 0.1 μm or more and 0.6 μm or less. When the median diameter is within the ranges mentioned above, toner particles having a desired particle diameter are easily obtained. The median diameter on a volume basis can be measured using a dynamic light scattering type particle size distribution meter (Nanotrac UPA-EX150: manufactured by Nikkiso).

Aggregation Process

The aggregation process is a process of mixing a colorant fine particle dispersion liquid and a release agent fine particle dispersion liquid with the above-described resin fine particle dispersion liquid to prepare a mixed liquid, and then aggregating the particles contained in the prepared mixed liquid to from an aggregate. As methods for forming the aggregate, a method including adding and mixing an aggregating agent in the mixed liquid, and then increasing the temperature of the mixture and a method including applying mechanical force and the like as appropriate can be suitably mentioned, for example.

The colorant fine particle dispersion liquid to be used in the aggregation process is prepared by dispersing the colorant. The colorant fine particles are dispersed by known methods and, for example, media type dispersing machines and high-pressure counter collision type dispersing machines, such as a rotation shearing-type homogenizer, a ball mill, a sand mill, and an attritor, are suitably used. Moreover, a surfactant and a polymer dispersant which give dispersion stability can be added as necessary.

The release agent fine particle dispersion liquid to be used in the aggregation process is prepared by dispersing the release agent in an aqueous medium. The release agent is dispersed by known methods and, for example, media type dispersing machines and high-pressure counter collision type dispersing machines, such as a rotation shearing-type homogenizer, a ball mill, a sand mill, and an attritor, are suitably used. Moreover, a surfactant and a polymer dispersant which give dispersion stability can be added as necessary.

Examples of the aggregating agent to be used in the aggregation process include metal salts of monovalent metals, such as sodium and potassium; metal salts of divalent metals, such as calcium and magnesium; trivalent metals, such as iron and aluminum; and polyvalent metal salts, such as aluminum polychloride, for example. It is suitable to use divalent metal salts, such as calcium chloride and magnesium sulfate, and polyvalent metal salts, such as aluminum polychloride, in combination from the viewpoint of particle diameter controllability of the aggregation process.

It is suitable to perform the addition and the mixing of the aggregating agent within the temperature range of room temperature to 65° C. When the mixing is performed under the temperature conditions, the aggregation proceeds in a stabilized state. The mixing can be performed using known mixing devices, a homogenizer, or a mixer.

The average particle diameter of the aggregate formed in the aggregation process is not particularly limited and may be usually controlled to 4.0 to 7.0 μm in such a manner as to be the same as the average particle diameter of the toner particles to be obtained. The control can be easily performed by setting and changing as appropriate the temperature in the addition and the mixing of the aggregating agent and the like and the stirring and mixing conditions, for example. The particle size distribution of the toner particles can be measured with a particle size distribution analyzer (Coulter Multisizer III: manufactured by Coulter) by a Coulter method.

Fusion Process

The fusion process is a process of heating the aggregate to a temperature equal to or higher than the melting point of the crystalline polyester resin for fusion to thereby produce particles in which the aggregate surface is smoothed. In order to prevent the melt-adhesion between the toner particles, a chelating agent, a pH adjuster, a surfactant, and the like can be charged as appropriate before a primary fusion process.

Examples of the chelating agent include alkali metal salts, such as ethylenediaminetetraacetic acid (EDTA) and a Na salt thereof, sodium gluconate, sodium tartrate, potassium citrate and sodium citrate, nitrotriacetate (NTA) salt, and a large number of water-soluble polymers (polyelectrolytes) including both functional groups COOH and OH.

The heating temperature may be a temperature between temperatures equal to or higher than the melting point of the crystalline polyester resin contained in the aggregate and a temperature at which the olefin-based copolymer or the crystalline polyester resin is thermally decomposed. The heating and fusion time is sufficiently a short time when the heating temperature is high and is required to be long when the heating temperature is low. More specifically, the heating and fusion time depends on the heating temperature, and therefore cannot be unconditionally specified but the heating and fusion time is generally 10 minutes to 10 hours.

Cooling Process

The cooling process is a process of lowering the temperature of the aqueous medium containing the particles to a temperature lower than the crystallization temperature of the olefin-based copolymer. When the cooling is not performed in such a manner that the temperature reaches a temperature lower than the crystallization temperature, coarse particles are generated. A specific cooling rate is 0.1 to 50° C./min It is suitable to hold the temperature at a temperature at which the crystallization rate of the olefin-based copolymer is high during cooling or after cooling, and then perform annealing which promotes the crystallization. By holding the temperature at a temperature of 30 to 70° C., the crystallization is promoted, so that the blocking property during storage of the toner is improved.

Washing Process

By repeatedly performing washing and filtration of the particles produced through the processes, the impurities in the toner can be removed. Specifically, the toner is washed using pure water or alcohol solvents, such as methanol or ethanol, and then filtration is repeatedly performed two or more times, whereby the metal salts, the surfactants, and the like in the toner can be removed. The number of times of the filtration is preferably 3 to 20 times from the viewpoint of production efficiency and more preferably 3 to 10 times.

Drying Process

The particles obtained in the process are dried, and, as necessary, inorganic powder, such as silica, alumina, titania, and calcium carbonate, and resin particles, such as vinyl-based resin, polyester resin, and silicone resin, may be added while applying shearing force in a dry state. These inorganic powder and the resin particles function as external additives, such as a fluidity assistant and a cleaning assistant.

EXAMPLES

Hereinafter, the present disclosure is described in more detail with reference to Examples and Comparative Examples but aspects of the present disclosure are not particularly limited thereto. The "part(s)" and "%" in Examples and Comparative Examples are based on mass unless otherwise particularly specified.

Production of Dispersion Liquid of Resin Fine Particles 1

Toluene (manufactured by Wako Pure Chemical Industries, Ltd.): 300 g

Ethylene-vinyl acetate copolymer A (Unit ratio derived from vinyl acetate: 15% by mass, Weight average molecular weight: 110000, Melt flow rate: 12 g/10 min, Melting point: 86° C., Fracture elongation=700%, (l+m+n)/W=0.99): 100 g Crystalline polyester resin A (Composition (Molar ratio) [1,9-nonanediol:Sebacic acid=100:100], Number average molecular weight (Mn)=5,500, Weight average molecular weight (Mw)=15,500, Peak molecular weight (Mp)=11,400, Melting point=72° C., Acid value=13 mgKOH/g): 25 g The above substances are mixed according to the formula above, and then dissolved at 90° C.

Separately, 12 g of sodium dodecylbenzenesulfonate, 6.0 g of sodium laurate, 1 g of N,N-dimethylamino ethanol were added to 700 g of ion exchange water, and then the mixture was heated at 90° C. to be dissolved. Subsequently, the toluene solution and an aqueous solution were mixed, and then the mixture was stirred at 7000 rpm using an ultrahigh speed stirring device T.K. Robomix (manufactured by PRIMIX Corporation). Furthermore, the resultant mixture was emulsified at a pressure of 200 MPa using a high pressure impact type dispersing machine Nanomizer (manufactured by yoshida kikai co., ltd). Thereafter, the toluene was removed using an evaporator, and then the density was adjusted with ion exchange water to obtain an aqueous dispersion liquid having 20% density of the resin fine particles 1 (Dispersion liquid of resin fine particles 1).

The median diameter on a volume basis of the resin fine particles 1 was 0.45 μm as measured using a dynamic light scattering type particle size distribution meter (Nanotrac: manufactured by Nikkiso).

Production of Dispersion Liquid of Resin Fine Particles 2

A dispersion liquid of resin fine particles 2 was obtained in the same manner as in the method for producing the dispersion liquid of resin fine particles 1, except changing the use amount of the crystalline polyester resin A to 15 g. The median diameter on a volume basis of the obtained resin fine particles 2 was 0.55 μm.

Production of Dispersion Liquid of Resin Fine Particles 3

A dispersion liquid of resin fine particles 3 was obtained in the same manner as in the method for producing the dispersion liquid of resin fine particles 1, except changing the ethylene-vinyl acetate copolymer A to an ethylene-vinyl acetate copolymer B (Unit ratio derived from vinyl acetate: 20% by mass, Melt flow rate: 14 g/min, Melting point: 75° C., Fracture elongation=800%, (l+m+n)/W=0.99). The median diameter on a volume basis of the obtained resin fine particles 3 was 0.41 μm.

Production of Dispersion Liquid of Resin Fine Particles 4

A dispersion liquid of resin fine particles 4 was obtained in the same manner as in the method for producing the dispersion liquid of resin fine particles 1, except changing the ethylene-vinyl acetate copolymer A to an ethylene-vinyl acetate copolymer C (Unit ratio derived from vinyl acetate: 28% by mass, Melt flow rate: 20 g/10 min, Melting point: 69° C., Fracture elongation=800%, (l+m+n)/W=0.99.) The median diameter on a volume basis of the obtained resin fine particles 4 was 0.41 μm.

Production of Dispersion Liquid of Resin Fine Particles 5

A dispersion liquid of resin fine particles 5 was obtained in the same manner as in the method for producing the dispersion liquid of resin fine particles 1, except changing the ethylene-vinyl acetate copolymer A to an ethylene-vinyl acetate copolymer D (Unit ratio derived from vinyl acetate: 6% by mass, Melt flow rate: 75 g/10 min, Melting point: 96° C., Fracture elongation=460%, (l+m+n)/W=0.99). The median diameter on a volume basis of the obtained resin fine particles 5 was 0.38 μm.

Production of Dispersion Liquid of Resin Fine Particles 6

A dispersion liquid of resin fine particles 6 was obtained in the same manner as in the method for producing the dispersion liquid of resin fine particles 1, except changing the ethylene-vinyl acetate copolymer A to an ethylene-vinyl acetate copolymer E (Unit ratio derived from vinyl acetate: 20% by mass, Melt flow rate: 200 g/10 min, Melting point: 75° C., Fracture elongation=210%, (l+m+n)/W=0.99) and not using the crystalline polyester resin A. The median diameter on a volume basis of the obtained resin fine particles 6 was 0.22 μm.

Production of Dispersion Liquid of Resin Fine Particles 7

A dispersion liquid of resin fine particles 7 was obtained in the same manner as in the method for producing the dispersion liquid of resin fine particles 1, except changing the ethylene-vinyl acetate copolymer A to an ethylene-vinyl acetate copolymer F (Unit ratio derived from vinyl acetate: 41% by mass, Melt flow rate: 2.0 g/10 min, Melting point: 40°, Fracture elongation=870%, (l+m+n)/W=0.99). The median diameter on a volume basis of the obtained resin fine particles 7 was 0.27 μm.

Production of Dispersion Liquid of Resin Fine Particles 8

A dispersion liquid of resin fine particles 8 was obtained in the same manner as in the method for producing the dispersion liquid of resin fine particles 1, except changing the ethylene-vinyl acetate copolymer A to an ethylene-vinyl acetate copolymer G (Unit ratio derived from ethylene-vinyl acetate: 2% by mass, Melt flow rate: 3.0 g/10 min, Melting point: 113° C., Fracture elongation=600%, (l+m+n)/W=0.99). The median diameter on a volume basis of the obtained resin fine particles 8 was 0.38 μm.

Production of Dispersion Liquid of Resin Fine Particles 9

A dispersion liquid of resin fine particles 9 was obtained in the same manner as in the method for producing the dispersion liquid of resin fine particles 1, except changing the ethylene-vinyl acetate copolymer A to an ethylene-ethyl acrylate copolymer H (Unit ratio derived from ethyl acrylate: 25% by mass, Melt flow rate: 20 g/10 min, Melting point: 91° C., Fracture elongation=900%, (l+m+n)/W=0.99). The median diameter on a volume basis of the obtained resin fine particles 9 was 0.44 μm.

Production of Dispersion Liquid of Resin Fine Particles 10

A dispersion liquid of resin fine particles 10 was obtained in the same manner as in the method for producing the dispersion liquid of resin fine particles 1, except changing the ethylene-vinyl acetate copolymer A to an ethylene-methyl acrylate copolymer I (Unit ratio derived from methyl acrylate: 14% by mass, Melt flow rate: 14 g/10 min, Melting point: 87° C., Fracture elongation=800%, (l+m+n)/W=0.99). The median diameter on a volume basis of the obtained resin fine particles 10 was 0.42 μm.

Production of Dispersion Liquid of Resin Fine Particles 11

A dispersion liquid of resin fine particles 11 was obtained in the same manner as in the method for producing the dispersion liquid of resin fine particles 1, except changing the ethylene-vinyl acetate copolymer A to an ethylene-ethyl methacrylate copolymer J (Unit ratio derived from ethyl methacrylate: 18% by mass, Melt flow rate: 7.0 g/10 min, Melting point: 89° C., Fracture elongation=750%, (l+m+n)/W=0.99). The median diameter on a volume basis of the obtained resin fine particles 11 was 0.45 μm.

Production of Dispersion Liquid of Resin Fine Particles 12

A dispersion liquid of resin fine particles 12 was obtained in the same manner as in the method for producing the dispersion liquid of resin fine particles 1, except changing the ethylene-vinyl acetate copolymer A to an ethylene-vinyl acetate-vinyl valerate copolymer K (Unit ratio derived from vinyl acetate: 14% by mass or more, Unit ratio derived from vinyl valerate: 6% by mass, Melt flow rate: 14 g/10 min, Melting point: 83° C., Fracture elongation=750%, (l+m+n)/W=0.94). The median diameter on a volume basis of the obtained resin fine particles 12 was 0.85 μm.

Production of Dispersion Liquid of Resin Fine Particles 13

A dispersion liquid of resin fine particles 13 was obtained in the same manner as in the method for producing the dispersion liquid of resin fine particles 1, except changing the ethylene-vinyl acetate copolymer A to an ethylene-vinyl acetate-vinyl alcohol copolymer L (Unit ratio derived from vinyl acetate: 8% by mass, Unit ratio derived from vinyl valerate: 20% by mass, Melt flow rate: 11 g/10 min, Melting point: 89° C., Fracture elongation=800%, (l+m+n)/W=0.80). The median diameter on a volume basis of the obtained resin fine particles 13 was 0.91 μm.

Production of Dispersion Liquid of Resin Fine Particles 14

A dispersion liquid of resin fine particles 14 was obtained in the same manner as in the method for producing the dispersion liquid of resin fine particles 1, except changing the ethylene-vinyl acetate copolymer A to an ethylene-vinyl acetate-ethyl acrylate copolymer M (Unit ratio derived from vinyl acetate: 7.5% by mass, Unit ratio derived from ethyl acrylate: 7.5% by mass, Melt flow rate: 13 g/10 min, Melting point: 86° C., Fracture elongation=700%, (l+m+n)/W=0.99). The median diameter on a volume basis of the obtained resin fine particles 14 was 0.55 μm.

Production of Dispersion Liquid of Resin Fine Particles 15

A dispersion liquid of resin fine particles 15 was obtained in the same manner as in the method for producing the dispersion liquid of resin fine particles 1, except not using the crystallinity polyester resin A. The median diameter on a volume basis of the obtained resin fine particles 15 was 5.51 μm.

Production of Dispersion Liquid of Resin Fine Particles 16

A dispersion liquid of resin fine particles 16 was obtained in the same manner as in the method for producing the dispersion liquid of resin fine particles 1, except not using the ethylene-vinyl acetate copolymer A and changing the use amount of the crystalline polyester resin A to 100 g. The median diameter on a volume basis of the obtained resin fine particles 16 was 0.33 μm.

Production of Dispersion Liquid of Resin Fine Particles 17

A dispersion liquid of resin fine particles 17 was obtained in the same manner as in the method for producing the dispersion liquid of resin fine particles 1, except changing the ethylene-vinyl acetate copolymer A to a polyester resin A [Composition (Molar ratio) [Polyoxypropylene (2.2)-2,2-bis(4-hydroxyphenyl)propane:Isophthalic acid:Terephthalic acid=100:50:50], Number average molecular weight (Mn)=4,600, Weight average molecular weight (Mw)=16,500, Peak molecular weight (Mp)=10,400, Glass transition temperature (Tg)=70° C., Acid value=13 mgKOH/g]. The median diameter on a volume basis of the obtained resin fine particles 17 was 0.15 μm.

Production of Dispersion Liquid of Resin Fine Particles 18

A dispersion liquid of resin fine particles 18 was obtained in the same manner as in the method for producing the dispersion liquid of resin fine particle 9, except not using the crystalline polyester resin A. The median diameter on a volume basis of the obtained resin fine particles 18 was 4.95 μm.

Production of Colorant Fine Particle Dispersion Liquid

| | |
|---|---|
| Colorant (Cyan pigment, manufactured by Dainichiseika Color & Chemicals Mfg. Co., Ltd.: Pigment Blue 15:3) | 10.0 parts by mass |
| Anionic surfactant (manufactured by Daiichi Kogyo Seiyaku Co., Ltd.: NEOGEN RK) | 1.5 parts by mass |
| Ion exchange water | 88.5 parts by mass |

The substances above were mixed and dissolved, and then dispersed for about 1 hour using a high-pressure impact type dispersing machine Nanomizer (manufactured by yoshida kikai co., ltd) to prepare an aqueous dispersion liquid (Colorant fine particle dispersion liquid) having 10% density of the colorant fine particles in which the colorant was dispersed. The median diameter on a volume basis of the obtained colorant fine particles was 0.20 μm as measured using a dynamic light scattering type particle size distribution meter (Nanotrac: manufactured by Nikkiso).

Production of Dispersion Liquid of Fine Particles of Aliphatic Hydrocarbon

| | |
|---|---|
| Aliphatic hydrocarbon (HNP-51, Melting point of 78° C., manufactured by NIPPON SEIRO) | 20.0 parts by mass |
| Anionic surfactant (manufactured by Daiichi Kogyo Seiyaku Co., Ltd.: NEOGEN RK) | 1.0 part by mass |
| Ion exchange water | 79.0 parts by mass |

The substances above were charged into a mixing vessel with a stirring device, heated to 90° C., and then circulated into a CLEARMIX W-MOTION (manufactured by M Technique) to be subjected to dispersion treatment for 60 minutes. The dispersion treatment conditions were as follows.

| | |
|---|---|
| Rotor | Outer diameter of 3 cm |
| Clearance | 0.3 mm |
| Rotor rotation speed | 19000 r/min |
| Screen rotation speed | 19000 r/min |

After the dispersion treatment, by cooling the resultant substance to 40° C. under the cooling processing conditions of a rotor rotation speed of 1000 r/min, a screen rotation speed of 0 r/min, and a cooling rate of 10° C./min, an aqueous dispersion liquid having 20% density of the fine particles of aliphatic hydrocarbon (dispersion liquid of the fine particles of aliphatic hydrocarbon) was obtained. The 50% particle diameter (d50) on a volume distribution basis of the fine particles of aliphatic hydrocarbon was 0.15 μm as measured using a dynamic light scattering type particle size distribution meter (Nanotrac: manufactured by Nikkiso).

Production of Silicone Oil Emulsion Liquid

| | |
|---|---|
| Silicone oil (Dimethyl silicone oil, manufactured by Shin-Etsu Chemical Co., Ltd.: KF96-50CS) | 20.0 parts by mass |
| Anionic surfactant (manufactured by Daiichi Kogyo Seiyaku Co., Ltd.: NEOGEN RK) | 1.0 part by mass |
| Ion exchange water | 79.0 parts by mass |

The substances above were mixed and dissolved, and then dispersed for about 1 hour using a high-pressure impact type dispersing machine Nanomizer (manufactured by yoshida kikai co., ltd) to prepare an aqueous dispersion liquid having 20% density of the silicone oil in which the silicone oil was dispersed. The median diameter on a volume basis of the silicone oil fine particles of the obtained silicone oil emulsion liquid was 0.09 μm as measured using a dynamic light scattering type particle size distribution meter (Nanotrac: manufactured by Nikkiso).

Example 1

| | |
|---|---|
| Dispersion liquid of resin fine particles 1 | 50 g |
| Dispersion liquid of colorant fine particles | 5 g |
| Dispersion liquid of fine particles of aliphatic hydrocarbon | 5 g |
| Ion exchange water | 10 g |

The materials above were charged in a round-shaped stainless steel flask, and then mixed. Thereafter, 3 g of a 2% aluminum polychloride aqueous solution and 30 g of a 2% magnesium sulfate aqueous solution were added. Subsequently, the mixture was dispersed for 10 minutes at 5000 r/min using a homogenizer (manufactured by IKA: ULTRA-TURRAX T50). Thereafter, the mixed liquid was heated to 60° C. using an impeller in a warming water bath while adjusting the rotation speed as appropriate in such a manner that the mixed liquid is stirred. After held at 60° C. for 20 minutes, the volume average particle diameter of the formed agglomerated particles was measured using a Coulter Multisizer III, and then it was confirmed that agglomerated particles having a volume average particle diameter of about 6.0 μm were formed.

120 g of a 5% sodium ethylenediaminetetraacetic acid aqueous solution was added to the dispersion liquid of the agglomerated particles, 2000 g of ion exchange water was added, and then the resultant mixed liquid was heated to 95° C. while continuing the stirring. Then, the mixed liquid was held at 95° C. for 1 hour to thereby fuse the agglomerated particles.

Thereafter, the resultant particles were cooled to 50° C., and then held at 50° C. for 3 hours to thereby promote the crystallization of the ethylene-vinyl acetate copolymer. Thereafter, the resultant particles were cooled to 25° C., and then filtrated for solid-liquid separation. Then, the filtered substance was sufficiently washed with ethanol and further washed with ion exchange water. After the washing, the resultant substance was dried using a vacuum dryer to thereby obtain toner particles 1 having a median diameter on a volume basis of 5.4 μm.

1.5 parts by mass of silica fine powder subjected to hydrophobic treatment having a primary particle diameter of 10 nm and 2.5 parts by mass of silica fine powder subjected to hydrophobic treatment having a primary particle diameter of 100 nm based on 100 parts by mass of the obtained toner particles were dry-blended with a Henschel mixer (manufactured by Mitsui Mining) to obtain toner. The DSC measurement of the obtained toner was performed.

Example 2

Toner 2 was obtained in the same manner as in Example 1, except changing the resin fine particles 1 to the resin fine particles 2 and changing the amount of the dispersion liquid of the fine particles of aliphatic hydrocarbon to 4.6 g. The median diameter on a volume basis of the obtained toner 2 was 5.6 μm.

Example 3

Toner 3 was obtained in the same manner as in Example 1, except not using the dispersion liquid of the fine particles of aliphatic hydrocarbon. The median diameter on a volume basis of the obtained toner 3 was 5.5 μm.

Example 4

Toner 4 was obtained in the same manner as in Example 1, except changing the resin fine particles 1 to the resin fine particles 3. The median diameter on a volume basis of the obtained toner 4 was 5.6 μm.

Example 5

Toner 5 was obtained in the same manner as in Example 1, except changing the resin fine particles 1 to the resin fine particles 4. The median diameter on a volume basis of the obtained toner 5 was 5.7 μm.

Example 6

A toner 6 was obtained in the same manner as in Example 1, except adding 5 g of the silicone oil emulsion liquid in the aggregation process. The median diameter on a volume basis of the obtained toner 6 was 5.2 μm.

Example 7

Toner 7 was obtained in the same manner as in Example 1, except changing 50 g of the dispersion liquid of the resin fine particles 1 to 40 g of the dispersion liquid of the resin fine particles 1 and 10 g of the dispersion liquid of the resin fine particles 17. The median diameter on a volume basis of the obtained toner 7 was 6.2 μm.

Example 8

Toner 8 was obtained in the same manner as in Example 1, except changing the resin fine particles 1 to the resin fine particles 9. The median diameter on a volume basis of the obtained toner 8 was 5.6 μm.

Example 9

Toner 9 was obtained in the same manner as in Example 1, except changing the resin fine particles 1 to the resin fine particles 10. The median diameter on a volume basis of the obtained toner 9 was 5.2 μm.

Example 10

Toner 10 was obtained in the same manner as in Example 1, except changing the resin fine particles 1 to the resin fine particles 11. The median diameter on a volume basis of the obtained toner 10 was 5.5 μm.

Example 11

Toner 11 was obtained in the same manner as in Example 1, except changing 50 g of the dispersion liquid of the resin fine particles 1 to 25 g of the dispersion liquid of the resin fine particles 1 and 25 g of the dispersion liquid of the resin fine particles 3. The median diameter on a volume basis of the obtained toner 11 was 6.2 μm.

Example 12

Toner 12 was obtained in the same manner as in Example 1, except changing the resin fine particles 1 to the resin fine particles 12. The median diameter on a volume basis of the obtained toner 12 was 5.2 μm.

Example 13

Toner 13 was obtained in the same manner as in Example 1, except changing the resin fine particles 1 to the resin fine particles 13. The median diameter on a volume basis of the obtained toner 13 was 5.0 μm.

Example 14

Toner 14 was obtained in the same manner as in Example 8, except not using the dispersion liquid of the fine particles of aliphatic hydrocarbon. The median diameter on a volume basis of the obtained toner 14 was 5.0 μm.

Example 15

Toner 15 was obtained in the same manner as in Example 8, except adding 5 g of the silicone oil emulsion liquid in the aggregation process. The median diameter on a volume basis of the obtained toner 15 was 5.1 μm.

Example 16

Toner 17 was obtained in the same manner as in Example 1, except changing 50 g of the dispersion liquid of the resin fine particles 1 to 35 g of the dispersion liquid of the resin fine particles 1 and 15 g of the dispersion liquid of the resin fine particles 17. The median diameter on a volume basis of the obtained toner 17 was 6.3 μm.

Example 17

Toner 17 was obtained in the same manner as in Example 1, except changing 50 g of the dispersion liquid of the resin fine particles 1 to 25 g of the dispersion liquid of the resin fine particles 1 and 25 g of the dispersion liquid of the resin fine particles 9. The median diameter on a volume basis of the obtained toner 17 was 5.6 μm.

Example 18

Toner 18 was obtained in the same manner as in Example 1, except changing the resin fine particles 1 to the resin fine particles 14. The median diameter on a volume basis of the obtained toner 18 was 5.2 μm.

Comparative Example 1

Toner 19 was obtained in the same manner as in Example 1, except changing the resin fine particles 1 to the resin fine particles 5. The median diameter on a volume basis of the obtained toner 19 was 5.1 μm.

Comparative Example 2

Toner 20 was obtained in the same manner as in Example 1, except changing the resin fine particles 1 to the resin fine particles 6. The median diameter on a volume basis of the obtained toner 20 was 5.3 μm.

Comparative Example 3

Toner 21 was obtained in the same manner as in Example 1, except changing the resin fine particles 1 to the resin fine particles 7. The median diameter on a volume basis of the obtained toner 21 was 7.2 μm.

Comparative Example 4

Toner 22 was obtained in the same manner as in Example 1, except changing the resin fine particles 1 to the resin fine particles 8. The median diameter on a volume basis of the obtained toner 22 was 10.5 μm.

Comparative Example 5

Toner 23 was obtained in the same manner as in Example 1, except changing the resin fine particles 1 to the resin fine particles 15. The median diameter on a volume basis of the obtained toner 23 was 7.0 μm.

Comparative Example 6

Toner 24 was obtained in the same manner as in Example 1, except changing the resin fine particles 1 to the resin fine particles 16. The median diameter on a volume basis of the obtained toner 24 was 5.5 μm.

Comparative Example 7

Toner 25 was obtained in the same manner as in Example 1, except changing the resin fine particles 1 to the resin fine particles 17. The median diameter on a volume basis of the obtained toner 25 was 5.0 μm.

Comparative Example 8

Toner 26 was obtained in the same manner as in Example 1, except changing 50 g of the dispersion liquid of the resin fine particles 1 to 15 g of the dispersion liquid of the resin fine particles 1 and 35 g of the dispersion liquid of the resin fine particles 17. The median diameter on a volume basis of the obtained toner 26 was 6.2 μm.

Comparative Example 9

Toner 27 was obtained in the same manner as in Example 1, except changing the resin fine particles 1 to the resin fine particles 18. The median diameter on a volume basis of the obtained toner 27 was 6.9 μm.

The following evaluation tests were performed using each toner above. The evaluation results are shown in Table 2.

Evaluation of Storage Stability (Blocking Resistance)

Each toner above was allowed to stand still for 2 weeks in a thermohygrostat under conditions of 40° C. and 95% humidity, and then the blocking degree was visually observed.

A: Blocking does not occur or even when blocking occurs, the toner is easily dispersed by light vibration.

B: Although blocking occurs, the toner is dispersed when continuously vibrated.

C: Blocking occurs, and even when force is applied, the toner is not dispersed.

Evaluation of Storage Stability in Severe Environment

Each toner was allowed to stand still for 30 days in a thermohygrostat under conditions of 40° C. and 95% humidity, and then the blocking degree was visually observed.

A: Blocking does not occur or even when blocking occurs, the toner is easily dispersed by light vibration.

B: Although blocking occurs, the toner is dispersed when continuously vibrated.

C: Blocking occurs, and even when force is applied, the toner is not dispersed.

Evaluation of Low-Temperature Fixability

Each toner above and a ferrite carrier (Average particle diameter of 42 μm) having a surface coated with a silicone resin were mixed in such a manner that the toner density was 8% by mass to prepare a two-component developing agent. Using a commercially-available full color digital copier (CLC1100, manufactured by CANON KABUSHIKI KAISHA), an unfixed toner image (0.6 mg/cm$^2$) was formed on an image receiving paper (64 g/m$^2$). A fixing unit removed from a commercially-available full color digital copier (imageRUNNER ADVANCE C5051, manufactured by CANON KABUSHIKI KAISHA) was converted in such a manner that the fixing temperature was able to be adjusted, and a fixing test of the unfixed image was carried out using the converted copier. The process speed was set to 246 mm/second under normal temperature and normal humidity, and then the state where the unfixed image was fixed was visually evaluated.

A: The image can be fixed at a temperature of 120° C. or less.

B: The image can be fixed at a temperature of higher than 120° C. and 140° C. or less.

C: The image can be fixed at a temperature of higher than 140° C. or there is no temperature region in which the image can be fixed.

Evaluation of Charge Retention 0.01 g of each toner was measured in an aluminum pan, and then was charged to −600 V using a scorotron charging device. Subsequently, the change behavior of the surface potentials was measured for 30 minutes using a surface potential meter (manufactured by TREK JAPAN, Mode 1347) under the atmosphere of a temperature of 25° C. and a humidity of 50%. The charge retention was calculated from the measured results by the following expression.

Charge retention after 30 minutes (%)=(Surface potential after 30 minutes/Initial surface potential)×100

A: The charge retention is 90% or more.

B: The charge retention is 50% or more and less than 90%.

C: The charge retention is 10% or more and less than 50%.

D: The charge retention is less than 10%.

Evaluation of Gloss

Each toner and a ferrite carrier (Average particle diameter of 42 μm) having a surface coated with a silicone resin were mixed in such a manner that the toner density was 8% by mass to prepare a two-component developing agent. Using a commercially-available full color digital copier (CLC1100, manufactured by CANON KABUSHIKI KAISHA), an unfixed toner image (0.6 mg/cm$^2$) was formed on an image receiving paper (64 g/m$^2$). A fixing unit removed from a commercially-available full color digital copier (imageRUNNER ADVANCE C5051, manufactured by CANON KABUSHIKI KAISHA) was converted in such a manner that the fixing temperature was able to be adjusted, and a fixing test of the unfixed image was carried out using the converted copier. The process speed was set to 246 mm/second and the temperature of the heating roller was set to 140° C. under normal temperature and normal humidity, and then the unfixed image was fixed. Then, the 75° gloss was measured and evaluated with a glossmeter (manufactured by Nippon Denshoku: VG7000).

A: The 75° gloss is 10 or more.

B: The 75° gloss is less than 10.

Evaluation of Image Density

The image fixed in the gloss evaluation was measured and evaluated using an image densitometer (manufactured by X-rite: Spectrodensitometer).

A: Image density is 0.6 or more.

B: Image density is less than 0.6.

TABLE 1

| | Olefin-based copolymer | | | | | Proportion of olefin-based copolymer | Amount based on 100 parts by mass of resin component | | |
|---|---|---|---|---|---|---|---|---|---|
| | Olefin-based copolymer type | Proportion of unit Y2 (% by mass) | Melt flow rate (g/10 min) | Melting point (° C.) | Fracture elongation (%) | in resin component (% by mass) | Crystalline polyester (parts by mass) | Aliphatic hydrocarbon (parts by mass) | Silicone oil (parts by mass) |
| Ex. 1 | A | 15 | 12 | 86 | 700 | 80 | 20 | 10 | — |
| Ex. 2 | A | 15 | 12 | 86 | 700 | 87 | 13 | 10 | — |
| Ex. 3 | A | 15 | 12 | 86 | 700 | 80 | 20 | — | — |
| Ex. 4 | B | 20 | 14 | 75 | 800 | 80 | 20 | 10 | — |
| Ex. 5 | C | 28 | 20 | 69 | 800 | 80 | 20 | 10 | — |
| Ex. 6 | A | 15 | 12 | 86 | 700 | 80 | 20 | 10 | 10 |
| Ex. 7 | A | 15 | 12 | 86 | 700 | 64 | 20 | 10 | — |
| Ex. 8 | H | 25 | 20 | 91 | 900 | 80 | 20 | 10 | — |
| Ex. 9 | I | 14 | 14 | 87 | 800 | 80 | 20 | 10 | — |
| Ex. 10 | J | 18 | 7 | 89 | 750 | 80 | 20 | 10 | — |
| Ex. 11 | A + B | 17.5 | 12 | 84 | 700 | 80 | 20 | 10 | — |
| Ex. 12 | K | 14 | 14 | 83 | 750 | 80 | 20 | 10 | — |
| Ex. 13 | L | 8 | 11 | 89 | 800 | 80 | 20 | 10 | — |
| Ex. 14 | H | 25 | 20 | 91 | 900 | 80 | 20 | — | — |
| Ex. 15 | H | 25 | 20 | 91 | 900 | 80 | 20 | 10 | 10 |
| Ex. 16 | A | 15 | 12 | 86 | 700 | 56 | 20 | 10 | — |
| Ex. 17 | A + H | 20 | 16 | 88 | 850 | 80 | 20 | 10 | — |
| Ex. 18 | M | 7.5 + 7.5 | 13 | 86 | 700 | 80 | 20 | 10 | — |
| Comp. Ex. 1 | D | 6 | 75 | 96 | 460 | 80 | 20 | 10 | — |
| Comp. Ex. 2 | E | 20 | 200 | 75 | 210 | 100 | 0 | 10 | — |
| Comp. Ex. 3 | F | 41 | 2 | 40 | 870 | 80 | 20 | 10 | — |
| Comp. Ex. 4 | G | 2 | 3 | 113 | 600 | 80 | 20 | 10 | — |
| Comp. Ex. 5 | A | 15 | 12 | 86 | 700 | 100 | 0 | 10 | — |
| Comp. Ex. 6 | — | — | — | — | — | 100 | — | 10 | — |
| Comp. Ex. 7 | — | — | — | — | — | 80 | 20 | 10 | — |
| Comp. Ex. 8 | A | 15 | 12 | 86 | 700 | 24 | 20 | 10 | — |
| Comp. Ex. 9 | H | 14 | 14 | 87 | 800 | 100 | 0 | 10 | — |

TABLE 2

| | Toner evaluation results | | | | | | |
|---|---|---|---|---|---|---|---|
| | Endothermic amount (J/g) | Low-temperature fixability | Storage stability | Charge retention | Gloss | Image density | Storage stability in severe environment |
| Ex. 1 | 91 | A | A | A | A | A | B |
| Ex. 2 | 83 | B | A | A | A | A | B |
| Ex. 3 | 77 | B | B | B | A | A | B |
| Ex. 4 | 83 | A | B | B | A | A | B |
| Ex. 5 | 61 | A | B | C | A | A | B |
| Ex. 6 | 92 | A | A | A | A | A | B |
| Ex. 7 | 70 | B | A | A | A | A | B |
| Ex. 8 | 89 | B | A | B | A | A | A |
| Ex. 9 | 72 | B | A | A | A | A | A |
| Ex. 10 | 84 | B | A | A | A | A | A |
| Ex. 11 | 89 | A | B | B | A | A | B |
| Ex. 12 | 95 | B | A | B | A | A | B |
| Ex. 13 | 93 | B | A | B | A | A | B |
| Ex. 14 | 74 | B | B | B | A | A | B |
| Ex. 15 | 72 | B | A | A | A | A | A |
| Ex. 16 | 61 | B | B | B | A | A | B |
| Ex. 17 | 80 | A | A | A | A | A | B |
| Ex. 18 | 83 | A | A | A | A | A | B |
| Comp. Ex. 1 | 73 | A | C | A | A | A | C |
| Comp. Ex. 2 | 67 | A | C | A | A | B | C |
| Comp. Ex. 3 | 45 | A | C | D | B | B | C |
| Comp. Ex. 4 | 180 | C | A | A | B | B | A |
| Comp. Ex. 5 | 83 | C | A | A | B | B | B |
| Comp. Ex. 6 | 110 | A | B | D | A | A | B |

TABLE 2-continued

| | Toner evaluation results | | | | | | |
|---|---|---|---|---|---|---|---|
| | Endothermic amount (J/g) | Low-temperature fixability | Storage stability | Charge retention | Gloss | Image density | Storage stability in severe environment |
| Comp. Ex. 7 | 41 | C | A | B | A | A | B |
| Comp. Ex. 8 | 76 | C | B | B | A | A | B |
| Comp. Ex. 9 | 67 | C | A | A | B | B | A |

The present disclosure can provide toner excellent in image quality and excellent in low-temperature fixability in high-speed printing, storage stability, and chargeability.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-088543 filed Apr. 26, 2016 and No. 2015-107872 filed May 27, 2015, which are hereby incorporated by reference herein in their entirety.

What is claimed is:

1. Toner, comprising:

toner particles containing a resin component, wherein the resin component has an olefin-based copolymer and a crystalline polyester resin, the olefin-based copolymer has:

a unit Y1 represented by Formula (1) shown below; and at least one kind of unit Y2 selected from the group consisting of a unit represented by Formula (2) shown below; and a unit represented by Formula (3) shown below, a content of the olefin-based copolymer contained in the resin component is 50% by mass or more based on a total mass of the resin component, a content of the unit Y2 is 3% by mass or more and 35% by mass or less based on a total mass of the olefin-based copolymer, and a melt flow rate of the olefin-based copolymer is 30 g/10 min or less, Formula (1)

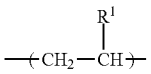

Formula (2)

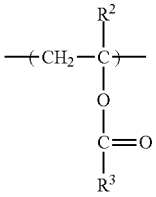

Formula (3)

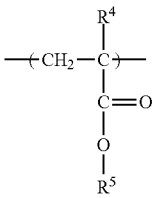

wherein, in Formulae (1) to (3), $R^1$ is H or $CH_3$, $R^2$ is H or $CH_3$, $R^3$ is $CH_3$ or $C_2H_5$, $R^4$ is H or $CH_3$, and $R^5$ is $CH_3$ or $C_2H_5$.

2. The toner according to claim 1, wherein when the total mass of the olefin-based copolymer is defined as W, a mass of the unit represented by Formula (1) above, a mass of the unit represented by Formula (2) above, and a mass of the unit represented by Formula (3) above is defined as l, m, and n, respectively, a (l+m+n)/W value is 0.8 or more.

3. The toner according to claim 1, wherein the olefin-based copolymer is at least one selected from the group consisting of a copolymer having a unit represented by Formula (1) above, wherein $R^1$ in Formula (1) above is H and a unit represented by Formula (3) above, wherein $R^4$ in Formula (3) above is H and $R^5$ in Formula (3) above is $CH_3$, a copolymer having a unit represented by Formula (1) above, wherein $R^1$ in Formula (1) above is H and a unit represented by Formula (3) above, wherein $R^4$ in Formula (3) above is H and $R^5$ in Formula (3) above is $C_2H_5$, and a copolymer having a unit represented by Formula (1) above, wherein $R^1$ in Formula (1) above is H and a unit represented by Formula (3) above, wherein $R^4$ in Formula (3) above is $CH_3$ and $R^5$ in Formula (3) above is $CH_3$.

4. The toner according to claim 1, wherein the toner particles contain aliphatic hydrocarbon having a melting point of 50° C. or more and 100° C. or less, and the aliphatic hydrocarbon is contained in a proportion of 1 part by mass or more and 30 parts by mass or less based on 100 parts by mass of the resin component.

5. The toner according to claim 1, wherein a content of the crystalline polyester resin in the toner particles is 10 parts by mass or more and 30 parts by mass or less based on 100 parts by mass of the resin component.

6. The toner according to claim 1, wherein the content of the unit Y2 in the olefin-based copolymer is 5% by mass or more and 20% by mass or less based on the total mass of the olefin-based copolymer.

7. The toner according to claim 1, wherein the toner particles contain silicone oil, and a content of the silicone oil in the toner particle is 1 part by mass or more and 20 parts by mass or less based on 100 parts by mass of the resin component.

8. The toner according to claim 1, wherein an endothermic amount in DSC measurement is 70 J/g or more and 150 J/g or less.

* * * * *